US006913007B2

(12) United States Patent
Bednar

(10) Patent No.: US 6,913,007 B2
(45) Date of Patent: Jul. 5, 2005

(54) CROSSBOW BOWSTRING DRAWING MECHANISM

(76) Inventor: William J. Bednar, 3895 Albrecht Ave., Akron, OH (US) 44312

( * ) Notice: Subject to any disclaimer, the term of this patent is extended or adjusted under 35 U.S.C. 154(b) by 0 days.

(21) Appl. No.: 10/278,423

(22) Filed: Oct. 23, 2002

(65) Prior Publication Data

US 2003/0089359 A1 May 15, 2003

Related U.S. Application Data

(63) Continuation of application No. 09/506,478, filed on Feb. 29, 2000, now Pat. No. 6,286,496, and a continuation of application No. 09/004,366, filed on Jan. 8, 1998, now Pat. No. 6,095,128.

(60) Provisional application No. 60/035,152, filed on Jan. 9, 1997.

(51) Int. Cl.[7] ..... F41B 5/12

(52) U.S. Cl. ..... 124/25

(58) Field of Search ..... 124/25

(56) References Cited

U.S. PATENT DOCUMENTS

| | | | | | |
|---|---|---|---|---|---|
| 3,043,287 | A | * | 7/1962 | Nelson | |
| 3,670,711 | A | * | 6/1972 | Firestone | 124/25 |
| 3,739,765 | A | * | 6/1973 | Moore | 124/25 |
| 4,192,281 | A | | 3/1980 | King | |
| 4,649,892 | A | * | 3/1987 | Bozek | 124/25 |
| 4,662,345 | A | * | 5/1987 | Stephens | 124/25 |
| 4,665,885 | A | * | 5/1987 | Glomski et al. | 124/27 |
| 4,719,897 | A | * | 1/1988 | Gaudreau | 124/25 |
| 4,721,092 | A | | 1/1988 | Waiser | |
| 4,942,861 | A | * | 7/1990 | Bozek | 124/25 |
| 5,115,795 | A | * | 5/1992 | Farris | 124/88 |
| 5,205,267 | A | * | 4/1993 | Burdick | 124/24.1 |
| 5,215,069 | A | | 6/1993 | Liu | |
| 5,220,906 | A | * | 6/1993 | Choma | 124/25 |
| 5,243,956 | A | * | 9/1993 | Luehring | 124/86 |
| 5,437,260 | A | * | 8/1995 | King | 81995/124 |
| 5,678,528 | A | | 10/1997 | Hadley | |
| 6,095,128 | A | | 8/2000 | Bednar | |

OTHER PUBLICATIONS

A Guide to the Crossbow by W.F. Patterson, published by the Society of Archer–Antiquaries; 1990.

Brochure entitled "ProLine Archery Systems" 1998.

European Crossbows: A Survey by Josef ALM; copyrighted in 1994 by the Trustees of the Royal Armouries and the Arms and Armour Society.

The Book of the Crossbow by Ralph Payne–Gallwey; published by Dover Publications, Inc. of New York.

* cited by examiner

*Primary Examiner*—John A. Ricci
(74) *Attorney, Agent, or Firm*—Brouse McDowell; Roger D. Emerson; John M. Skeriotis

(57) ABSTRACT

Crossbow bowstring drawing mechanisms which are integrated into or secured in the crossbow handle and which provide a straight and balanced draw to the crossbow bowstring to cock the crossbow bowstring in position in the crossbow trigger mechanism ready for firing. The cocking system can be manually operated or motorized, and can be manufactured as part of a crossbow or retrofit into a crossbow. An internal or external source of rotational power, such as hand crank, power screwdriver or an electrical motor, is preferably utilized in conjunction with a claw member including a bowstring engaging portion to translate rotation of the input source to longitudinal movement of the claw member to draw or release the crossbow bowstring resulting with minimal effort being expended by the user. The claw member may include adjustable cams used to center the claw member with respect to the crossbow barrel.

17 Claims, 9 Drawing Sheets

CROSSBOW BOWSTRING DRAWING MECHANISM

This is a Continuation Patent Application claiming priority from patent application Ser. No 09/506,478, filed Feb. 29, 2000 now U.S. Pat. No. 6,286,496, and is a continuation of U.S. utility patent application Ser. No. 09/004,366, filed Jan. 8, 1998 now U.S. Pat. No. 6,095,128. This application claims priority from U.S. Provisional Patent Application Ser. No. 60/035,152, filed Jan. 9, 1997.

BACKGROUND OF THE INVENTION

The present invention relates generally to crossbow bowstring drawing mechanisms. More particularly, the present invention relates to a crossbow bowstring drawing mechanism which may be integrated into a crossbow. The bowstring drawing mechanism may utilize either an integrated or external power source, such as a manually operated crank or motor, to draw the bowstring to its "cocked" or firing position. The mechanism may also be used to release the bowstring from the firing position and relieve the tension on the crossbow limbs.

Traditional archery devices have normally included a bow having two outwardly extending arms or limbs and a bowstring strung between the ends of the limbs. In order to shoot a projectile, such as an arrow, the user grasps the bow in approximately the center between the two outwardly extending arms and pulls back or "draws" the bowstring with one hand while at the same time pushing the bow away with the other hand. Drawing the bowstring requires a certain amount of strength and can, over time, take a physical toll on the user's arms. The amount of force needed to draw a given bow is normally measured in pounds and is known as the "draw weight" of a bow. Upon release of the bowstring from this "drawn" position, potential energy in the bowstring is imparted upon the projectile and the projectile is propelled or "fired".

One commonly used technique of increasing the speed and accuracy at which a projectile is propelled is to increase the stiffness of the outwardly extending bow limbs. However, if this is done, the pulling or "drawing" of the bowstring into position for "firing" requires more effort. At some point, simply increasing the stiffness of the outwardly extending bow arms becomes counterproductive since users do not have the physical strength to pull back or "draw" the bowstring into position for firing and maintain this position until the user has sighted his or her target and is ready to release the bowstring. Furthermore, if the user is struggling to maintain the "drawn" position of the bowstring, his or her aim will be negatively affected.

Crossbows were developed to assist the user in holding the bowstring in the "drawn" position and relieve the tension applied to users' arms when holding the bowstring in the "drawn" position while sighting a target. In a crossbow, a longitudinally extending main beam, commonly called the stock member, includes a trigger mechanism which holds the crossbow bowstring in the drawn position, allowing the user to sight a target without manually holding and maintaining the draw weight. This allows the stiffness of the bow limbs to be increased significantly, and modern crossbows can have bowstring pull weights of 150 pounds or more. Although the trigger maintains the drawn position of the bowstring, drawing the bowstring into engagement with the trigger mechanism is still very difficult. It is readily apparent that with high pull weights, even operating a crossbow could be difficult, if not impossible, for many users having limited physical strength. This is particularly true for target practice or other situations where the crossbow is cocked numerous times.

In order to draw the crossbow bowstring and "cock" the crossbow, the user must have sufficient physical strength to draw the full bowstring draw weight of the bow. Devices have been used in conjunction with crossbows to make this "cocking" operation easier for users to accomplish. For example, some crossbows include a stirrup bracket mounted on one end of the crossbow. In such crossbows, the user places the stirrup bracket onto the ground and places a foot in the stirrup bracket. By applying the user's body weight to the grounded stirrup bracket, the user can "draw" the crossbow bowstring into "cocked" position. Although helpful, this provides only limited advantage. In addition, it is very difficult to properly draw the bowstring in a manner that the limbs are each tensioned to the same degree, or the bow is drawn in a balanced manner.

Manual crank winch devices are also known which draw the crossbow bowstring into the cocked position. However, such devices are often large, heavy and cumbersome and must be connected and disconnected from the crossbow with each use. Furthermore, crossbows using leverage type "cocking" devices are known. Such crossbows typically have an arm which is pivoted to pull or push the crossbow bowstring into the cocked position. Various other arrangements to cock the bowstring have also been developed, including relatively complex devices utilizing pulley systems mounted to the frame of the crossbow.

None of these known arrangements have provided a system which easily and repeatably enables cocking of the crossbow bowstring in a cost effective integrated arrangement.

Another significant problem with respect to cocking of a crossbow bowstring as briefly mentioned above, whether performed manually or by means of a bowstring drawing mechanism such as described in known mechanisms above, is found in properly drawing the bowstring relative to the outwardly extending limbs of the crossbow such that when the bowstring is released from the crossbow trigger mechanism, an equalized force will be imparted to the projectile or arrow positioned therein. This balancing of the forces imparted on the bowstring by means of the crossbow limbs is particularly important for shooting accuracy in using the crossbow, and also adds to safety of use. It should be recognized that cocking the crossbow will many times result in uneven balancing of tension applied to each of the crossbow limbs, even if known cocking devices as described above are used. Further, although these known systems described above attempt to simplify the bowstring cocking procedure, in many cases the mechanisms add complexity or cost, or are cumbersome to handle and use effectively. None of the known arrangements provide an easy and effective system which automatically draws or releases a bowstring into or from a cocked position. Additionally, it would be desirable to be able to effectively retrofit a crossbow with a cocking mechanism.

SUMMARY OF THE INVENTION

Accordingly, an object of the present invention is to provide crossbow bowstring drawing mechanisms which are integral with the crossbow and which allow quick, quiet and efficient cocking of the crossbow bowstring with minimal effort being expended by the user.

Another object of the present invention is to provide crossbow bowstring drawing mechanisms which provide balanced drawing of the crossbow bowstring resulting in balanced tensioning of the crossbow limbs and bowstring to enhance accuracy and safety when the crossbow is fired.

Yet another object of the present invention is to provide crossbow bowstring drawing mechanisms which may include a variety of desirable options and different configurations which are compact, lightweight, cost effective and easy to use.

A further object of the invention is to provide a cocking system which can be manually operated or motorized, and that can be manufactured as part of a crossbow or retrofit into a crossbow.

These and other objects of the present invention are attained by the provision of crossbow bowstring drawing mechanisms which are integrated into or secured in association with the stock of the crossbow and which provide balanced drawing of the crossbow bowstring to cock the crossbow bowstring in position in the crossbow trigger mechanism ready for firing. A gear mechanism is utilized in conjunction with a bowstring engaging member to translate rotation of the gear mechanism to longitudinal movement of the engaging member to draw or release the crossbow bowstring resulting in minimal effort being expended by the user.

DETAILED DESCRIPTION OF THE PREFERRED EMBODIMENTS

Figure 1:
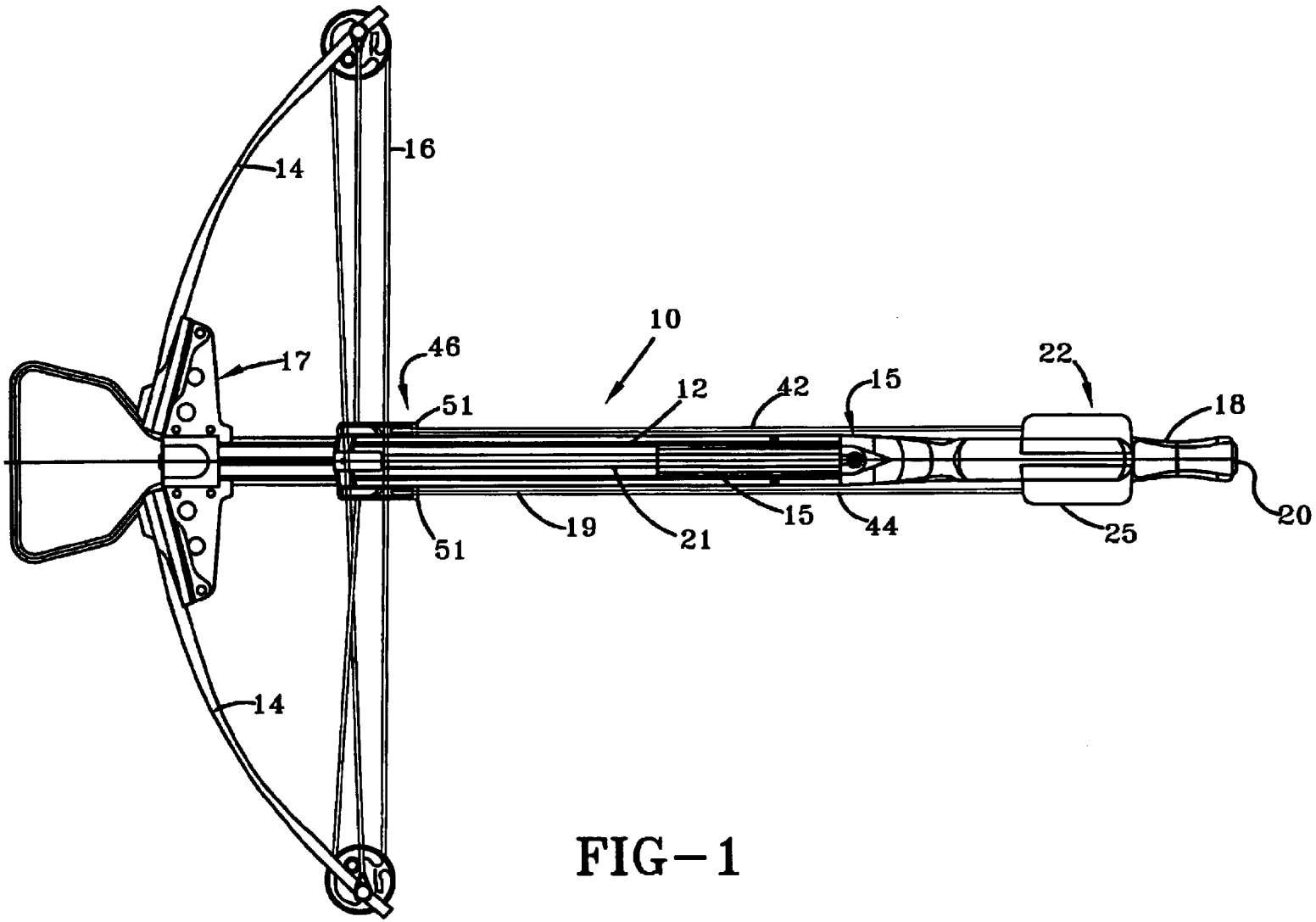
FIG. 1 illustrates a top view of a crossbow having a bowstring drawing mechanism in accordance with a first preferred embodiment of the present invention, the mechanism being shown in alternate operational positions.
Figure 2:
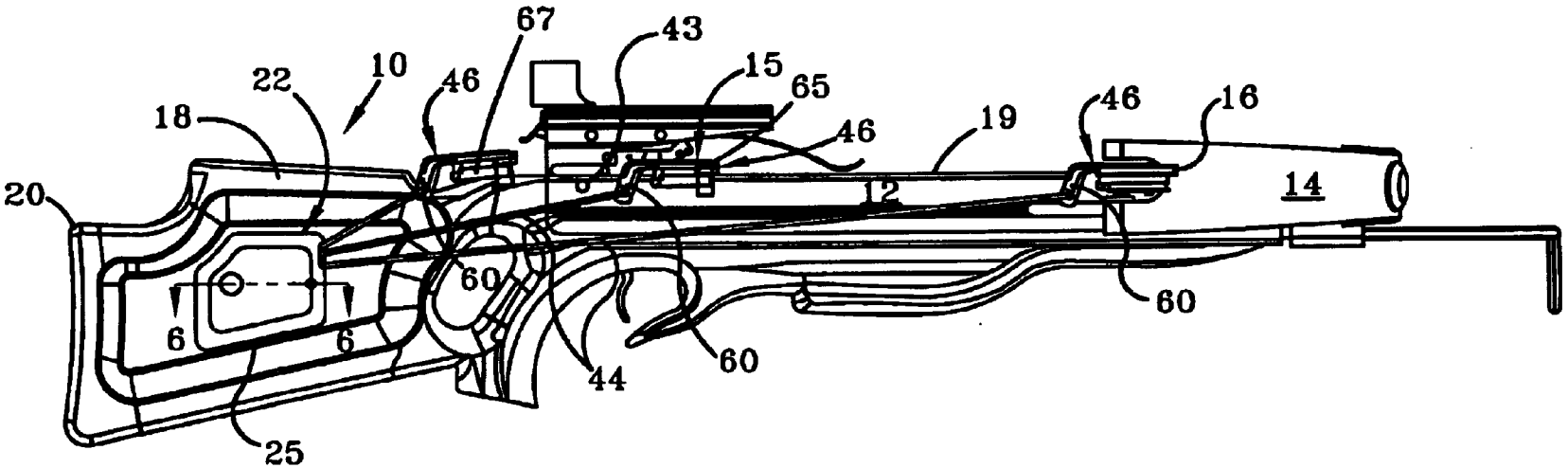
FIG. 2 illustrates a side view of the crossbow as shown in FIG. 1.

In the following detailed description of preferred embodiments of the present invention, reference is made to the accompanying drawings which, in conjunction with this detailed description, illustrate and describe preferred embodiments of a crossbow and bowstring drawing mechanism in accordance with the present invention. Referring now to the drawings, in which like-referenced elements indicate corresponding elements throughout the several views or embodiments. Attention is first directed to FIGS. 1 and 2, which illustrate a typical crossbow 10 having a bowstring drawing mechanism in accordance with a first preferred embodiment of the invention, and FIG. 2 illustrates a top view of crossbow 10. It should be understood that in accordance with the present invention, the bowstring drawing mechanism may be used with any type of crossbow, and no limitations with regard to the configuration of the crossbow generally exist. In one aspect of the invention, the bowstring drawing mechanism in accordance with the invention may be retrofit with an existing crossbow in a relatively simple fashion, or can be manufactured as part of a crossbow if desired. In either case, the drawing mechanism is integrated with the crossbow so as to be convenient and easily used, without hindering function and operation of the crossbow. The drawing mechanism indeed enhances operation of the crossbow by correctly drawing the bowstring in a balanced and equalized manner as will be hereinafter described.

A typical crossbow 10 generally consists of longitudinally extending main beam, barrel or stock member 12 and two outwardly extending limb members 14 which extend transversely on opposite sides from stock member 12. Crossbow bowstring 16 is strung between the distal ends of outwardly extending limbs 14. Stock member 12 generally includes a rear portion or tailstock 18 having an integrally formed butt portion 20. Butt portion 20 is normally positioned against the user's shoulder when crossbow 10 is being aimed and/or fired. The stock 12 further includes a forestock or barrel 19, which may be integral to the tailstock 18, or may be provided as a separate member secured therewith. In the preferred embodiment shown, the barrel 19 is a separate member which may be formed of a strong but lightweight material such as aluminum, to give added structural integrity without additional weight. For example, the barrel 19 may be an extruded member forming a hollow aluminum member which is held by the user for shooting of the crossbow. The barrel 19 includes an upper flat surface on which bowstring 16 slides in operation of the crossbow. Associated with the stock 12 is a trigger mechanism 15 of any suitable type, for selectively holding and releasing bowstring 16. The trigger mechanism of the invention does not constitute a limitation, and any suitable trigger mechanism may be used as will be appreciated by one skilled in the art. In general, trigger mechanism 15 will include a user actuated trigger which is pulled to selectively release a sear (not shown) used to hold bowstring 16 in the trigger mechanism 15 at a position adjacent the top surface of barrel 19. The barrel 19 alone or in conjunction with a portion of stock 12 has a length which allows the bowstring 16 to be drawn along an upper portion of barrel 19 and into the trigger mechanism 15 to cock the crossbow 10 for firing. In general the crossbow 10 may further include a riser block assembly 17 secured to the forward end of barrel 19, which supports the pair of outwardly extending limbs 14. The crossbow may be provided with pulley wheels, cams or other known arrangements affixed to the limbs 14 to carry bowstring 16 as well as tension cables in a compound bow arrangement. Any suitable compound arrangement may be used to allow the bowstring 16 to be drawn with an initial force which will build to a maximum limit and thereafter fall off as the crossbow is fully drawn. As the bowstring 16 is drawn, the bow limbs 14 are tensioned, thereby storing energy which is released upon release of the bowstring 16 from the trigger mechanism 15 to propel an arrow. To increase the speed at which an arrow is propelled from the crossbow 10, the stiffness of the bow limbs 14 may be increased, thereby increasing the amount of stored energy in the limbs upon cocking of the crossbow 10 for firing. The increased stiffness of the limbs 14 will correspondingly result in an increased pull weight associated with cocking of the crossbow 10. In the cocked position, bowstring 16 will be held in trigger mechanism 15, and an arrow (not shown) may be positioned in the upper surface of barrel 19 at the center thereof. In the preferred embodiment, the barrel 19 includes a central channel or arrow guide 21 to be hereinafter described in more detail.

Figure 3:
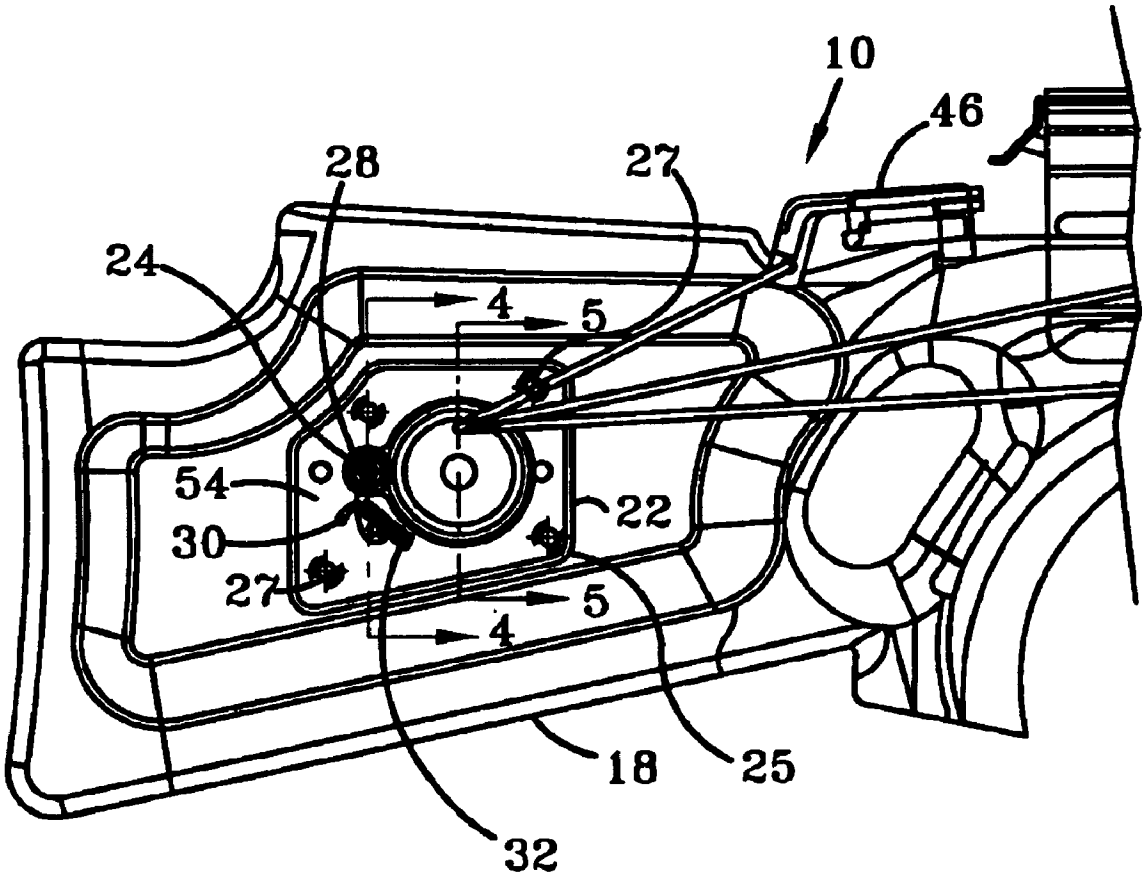
FIG. 3 shows an enlarged partial side view of the drawing mechanism according to the embodiment of FIG. 1.

A first embodiment of crossbow bowstring drawing mechanism, generally identified by reference numeral 22, is shown mounted in association with tailstock 18. Referring now to FIGS. 3 through 6, bowstring drawing mechanism 22 generally includes a housing 25, which may be secured to the tailstock 18 or may be an integral part thereof. In the preferred embodiment, the mechanism 22 is simply integrated into the tailstock 18, with tailstock 18 forming housing 25 and being provided with an access panel for example. Alternatively, a crossbow can be retrofitted with mechanism 22, with a separate housing 25 provided therewith. In FIG. 3, a cover of the housing 25 is removed for clarity, and also shows mounting plates 54, which are adapted to mount the drawing mechanism 22 in association with the stock 18 by means of screws or other fasteners 27. In the preferred embodiment, the drawing mechanism 22 is mounted within an aperture formed in tail stock 18, which again may be part of the originally fabricated tailstock 18 or may be formed in an existing tailstock to accept mechanism 22. In the preferred embodiment, the mounting plates 54 via fasteners 27 are fastened with respect to each side of tailstock 18 about the aperture formed therein. It should be recognized that a particular position of mounting plates 54 with respect to tailstock 18 can therefore be adjusted so as to center mechanism 22 within the tailstock 18. In this manner, the mechanism 22 is properly positioned with respect to the longitudinal axis of the crossbow 10, such that balanced retraction and cocking of the crossbow is achieved as will be described in more detail hereinafter. If the drawing mechanism 22 is produced as original equipment with crossbow 10, the design of tailstock 18 may be configured to allow centering of mechanism 22 along the longitudinal axis without adjustment via the mounting plates 54. Alternatively, if the mechanism 22 is retrofit into a crossbow 10, some adjustment may be necessary depending upon the characteristics of the tailstock 18, and mounting plates 54 in conjunction with fasteners 27 will allow accommodation of any design of tailstock 18. When mounted in this position, the mechanism 22 is conveniently out of the way of the user, and is positioned at a point where the most leverage can be applied to drawing the bowstring to its cocked position within trigger mechanism 15.

Within housing 25, there is rotationally mounted a drive shaft 24, preferably having a driving head configuration 26 at one end thereof. The driving head 26 is accessible through an opening in housing 25 or preferably extends to a position slightly outside of housing 25 for access thereto. The driving head 26 is designed to be driven by an external source such as a hand crank or a power driving source such as a power drill or screwdriver or some other source of external rotational power (not shown) which in turn rotates drive shaft 24. The driving head 26 may be magnetized to thereby hold the hand crank (or other external source) into operative engagement with the driving head 26. This reduces the chance of the external source inadvertently slipping off the driving head 26. In the preferred embodiment, the force required to crank shaft 24 is minimized via a reduction gear arrangement such that shaft 24 can be easily turned manually, although a power source can be used to virtually eliminate any effort of the user in cocking the crossbow 10, and instead relying upon the power source to drive the drive shaft 24. Even if a power source is used, the reduction gear arrangement minimizes the energy used by the power source to extend the battery life thereof as an example. The driving head 26 may thus be of any suitable configuration to be rotationally driven by an external source of this type, such as a hex head, slotted head or the like.

The drive shaft 24 in turn carries a gear mechanism which performs various functions. In the preferred embodiment, drive shaft 24 carries a rachet gear 28 which permits rotation of drive shaft 24 in one rotational direction, but prohibits rotation of drive shaft 24 in the other rotational direction through use of pawl 30 being resiliently biased by pawl spring 32 or other biasing member to a position between adjacent teeth of rachet gear 28. As will be described in more detail hereinafter, ratchet gear 28 will selectively prevent rotation of shaft 24 in the direction opposite to the drawing direction of the bowstring as a safety precaution in operation of mechanism 22. Other mechanisms to selectively prevent rotation of the drive shaft 24 are also contemplated in the invention. It should be recognized that when cocking the crossbow 10 using mechanism 22 of the invention, the provision of a mechanism like ratchet gear 28 and pawl 30 will prevent back winding or back sliding for safety in operation. Further, as stated previously, the drawing mechanism 22 may be used to selectively uncock the crossbow. In use of a crossbow, it is many times necessary to release a drawn bowstring from the trigger mechanism without an arrow in the firing position, a process which is very difficult for the user. The drawing mechanism 22 of the invention allows the bowstring to be engaged once it is released from the trigger mechanism, and selectively released to a relaxed position in a controlled manner. To perform this operation, the pawl 30 can be selectively disengaged from the ratchet gear 28 to allow opposite rotation of the drive shaft 24. Such manual operation will disengage pawl 30 against the biasing force of pawl spring 32, whereupon release of the pawl will automatically result in reengagement with the ratchet gear 28.

The teeth of rachet gear 28 are meshingly engaged with corresponding teeth on a drive gear 34 mounted on a pinion shaft 36. Upon rotation of rachet gear 28 in one rotational direction, drive gear 34, and thus pinion shaft 36, is driven in the opposite rotational direction. First hub 38 and second hub 40 are positioned at opposite ends of pinion shaft 36 and rotate upon rotation of pinion shaft 36. The drive gear 34 in relation to gear 28 provides a predetermined gear ratio which allows rotation of shaft 36 with less torque, and therefore allows an external rotational source such as a hand crank, power drill or the like to be easily used to retract bowstring 16 even though under significant tension in conjunction with bow limbs 14. The particular configuration of speed reduction gearing may be dependent upon the particulars of the crossbow 10, including the draw weight of the crossbow. In the preferred embodiment, the force required to rotate the drive shaft 24 is reduced to around 15–20 pounds at a maximum in drawing the bowstring to its cocked position. More or less force may obviously be designed into the reduction gear arrangement to set the force required at any predetermined amount, again depending upon the particulars of the crossbow with which the drawing mechanism 22 is used.

Figure 4:
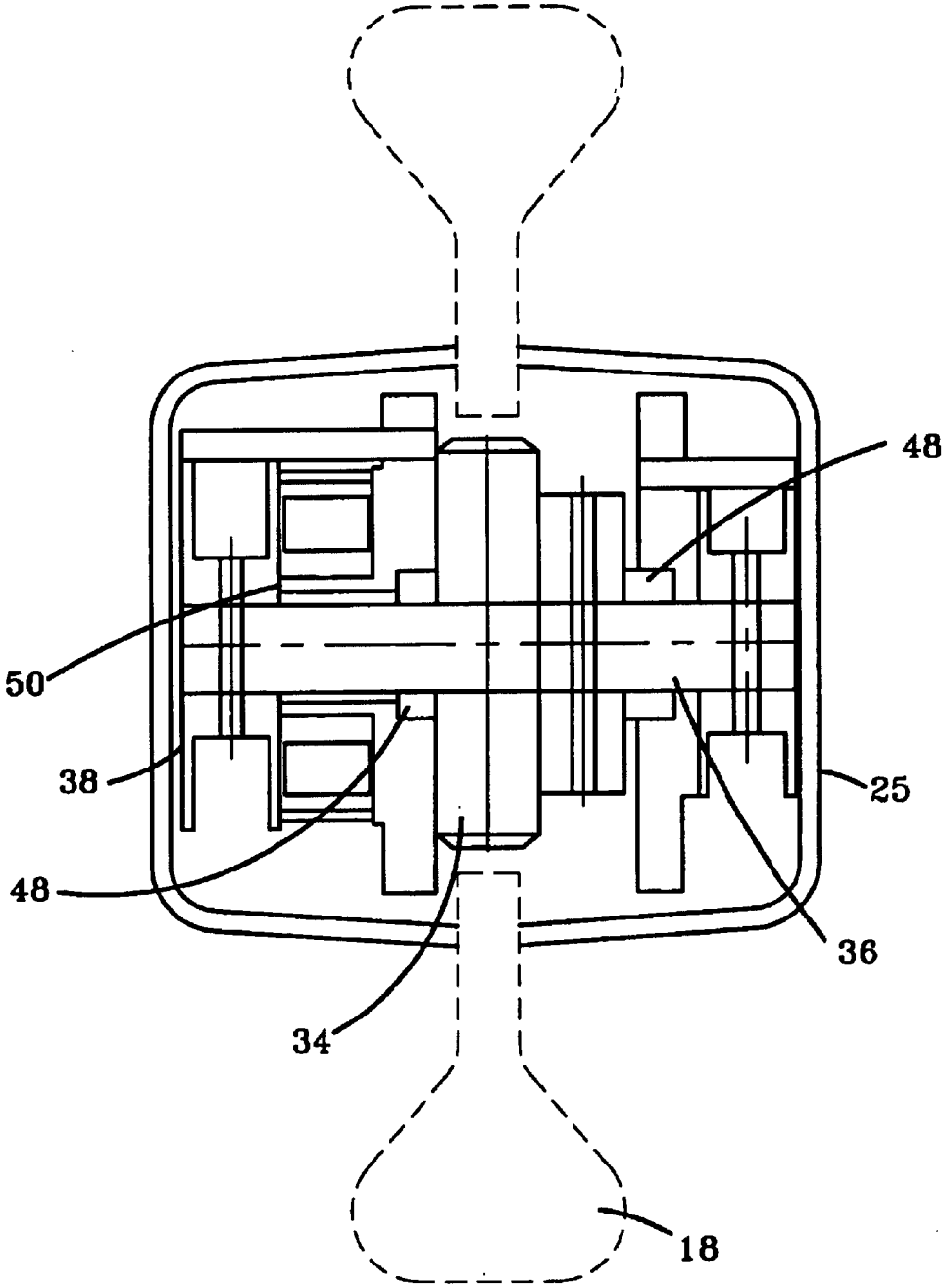
FIG. 4 illustrates a cross sectional view of the crossbow bowstring drawing mechanism as shown in FIG. 1 taken along line 4—4 in FIG. 3.
Figure 5:
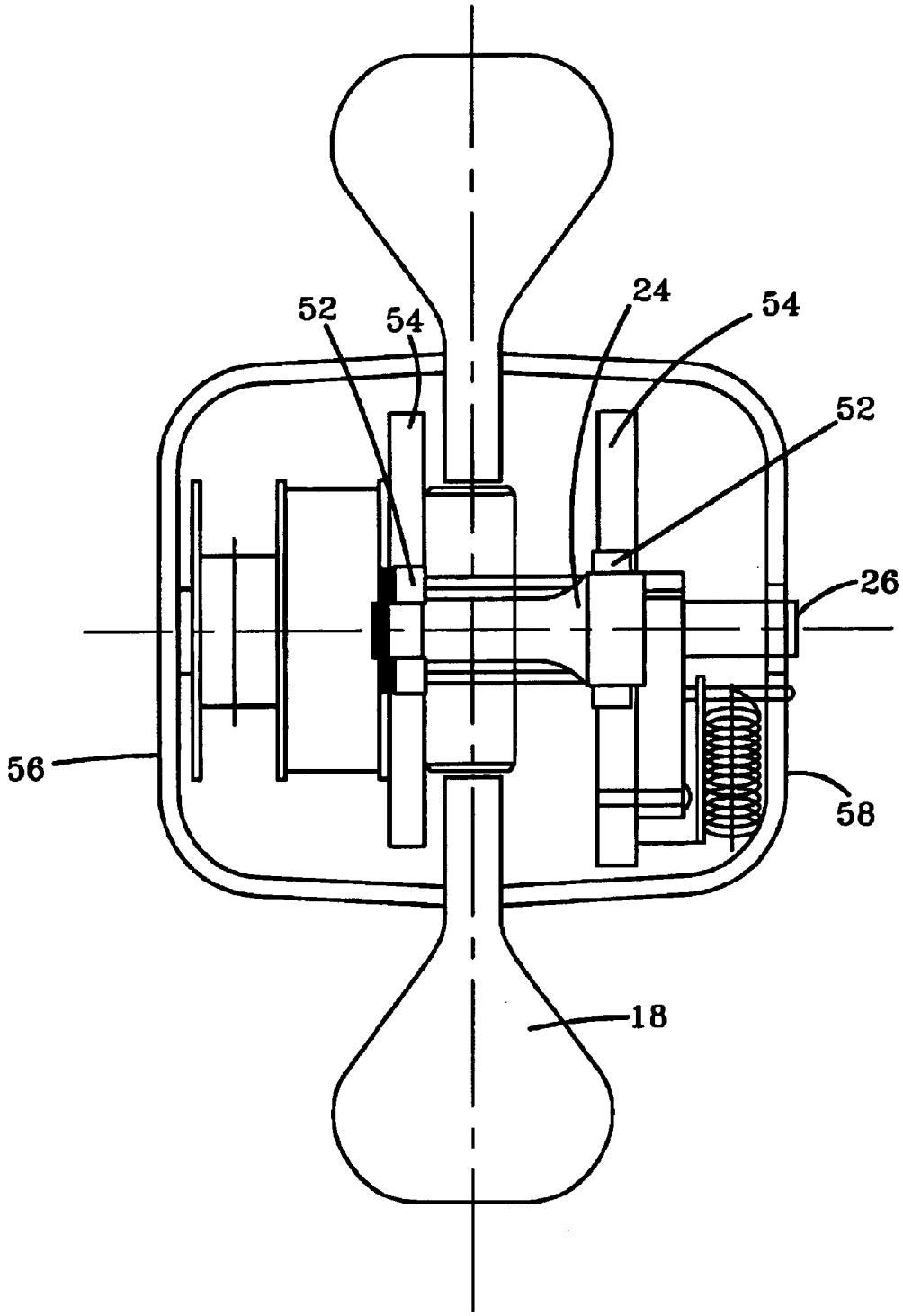
FIG. 5 illustrates a second cross sectional view of the crossbow bowstring drawing mechanism as shown in FIG. 1 taken along line 5—5 in FIG. 3.
Figure 6:
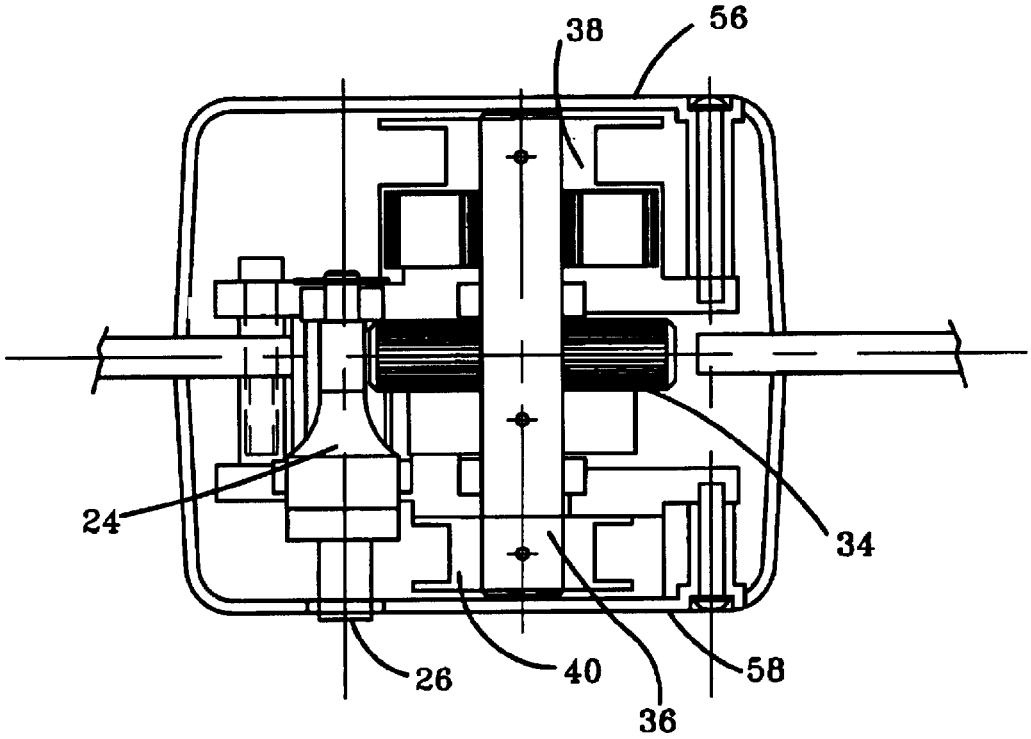
FIG. 6 illustrates a cross sectional view of the bowstring drawing mechanism as shown in FIG. 1 taken along line 6—6 in FIG. 2.

Referring now to FIG. 4, pinion shaft 36 is positioned and rotatably supported in bushings 48 and spring 50 is positioned around drive gear 34 to resiliently urge rotation of drive gear 34 in a preselected rotational direction dependent upon the rotational configuration of spring 50. The spring 50 is preferably a clock spring or similar mechanism which will operate to automatically retract the bowstring engaging mechanism which will be described hereafter. In the preferred embodiment, the spring 50 is fixed at one end with the other end coupled to a hub 38 forming a part of the drawing mechanism 22. The hub 38 rotates in response to rotation of drive shaft 24 and corresponding rotation of pinion shaft 36. Upon rotation of hub 38, the spring 50 is wound up, and subsequently functions to automatically retract a bowstring engaging mechanism or claw as will be hereinafter described in more detail. The spring 50 in general operates similarly to uses of such springs in tape measures or the like which automatically rewind for ease of use. Also, shown in FIG. 5, drive shaft 24 is positioned in bushings 52 to allow rotation with respect to other components. First side cover 56 and second side cover 58, both preferably fabricated from a plastic material, enclose crossbow bowstring drawing mechanism 22 with second side cover 58 having aperture 60 through which driving head 26 extends for attachment to the external rotational power source (not shown).

The drawing mechanism 22 preferably further includes a bowstring engaging mechanism or claw member 46 (see FIG. 1) which is utilized to engage the bowstring and to draw the bowstring into position in the crossbow trigger mechanism or alternatively to release the bowstring from the cocked position. The gear mechanism, including driveshaft 24, gears 28 and 34 and pinion shaft 36 in the preferred embodiment, is utilized in conjunction with a bowstring engaging member 46 to translate rotation of the gear mechanism to longitudinal movement of the engaging member 46 so as to draw or release the crossbow bowstring with minimal effort being expended by the user. The engaging claw 46 is particularly configured to operate in conjunction with first and second string or cable portions 42 and 44, and especially adapted to obtain balanced retraction of the bowstring in a cocking operation. In the preferred embodiment, as shown in the figures, the first string or cable portion 42 as shown in FIG. 1 is secured to first hub 38 (FIG. 6) and second string or cable portion 44 is secured to second hub 40. As will be hereinafter described in more detail, the cable portions 42 and 44 may be separate portions secured to hubs 38 and 40, although a single cable may be utilized which extends into engagement around claw member 46 (see FIG. 1) and between the respective hubs 38 and 40. In this description, the cable members 42 and 44 are described as portions extending on opposed sides of the barrel 19 of crossbow 10. When pinion shaft 36, and thus first and second hubs 38 and 40, are rotated in a first rotational direction, first string portion 42 is wound around first hub 38, and at the same time second string portion 44 is wound around second hub 40. The outwardly extending portion of each of the first and second string portions 42 and 44 becomes progressively shorter at substantially the same rate as they are wound about hubs 38 and 40. It can also be readily seen that if a portion of first string 42 is wound around first hub 38 and a portion of second string 44 is wound around second hub 40, rotation of pinion gear 36 in the opposite rotational direction will cause first and second strings 42 and 44 to unwind from hubs 38 and 40, thus causing the outwardly extending portion of each string portions 42 and 44 to become progressively longer at the same rate.

Figure 7:
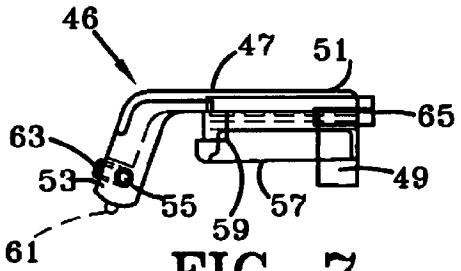
FIG. 7 illustrates the claw member of the crossbow bowstring mechanism in accordance with the preferred embodiment of the invention.

The first and second string portions 42 and 44 are preferably engaged with the string engaging or claw member 46 on opposed sides of barrel 19. The claw member 46, the preferred embodiment shown more distinctly in FIG. 7, is moved along longitudinally extending barrel 19 upon rotation of drive shaft 24 by the shortening or lengthening of string portions 42 and 44. In the preferred embodiments, the claw member 46 is specially designed to allow for balanced retraction of the bowstring during operation of the drawing mechanism 22, which is achieved by the cooperative relationship of the claw member 46 with respect to the barrel 19 of crossbow 10. The claw member 46 is preferably center guided as will be hereinafter described in more detail, and also preferably has a shape simulating a horseshoe or U-shaped configuration with outwardly extending arms preferably positioned to lie adjacent the outside edges of the barrel 19. Upon movement of the claw member 46 along barrel 19, the configuration of claw 46 will facilitate maintaining its position centered with respect to the barrel 19. Further, although a single string member could be utilized to move claw member 46, having first and second string portions 42 and 44 attached to the claw 46 as described herein is preferred. Attachment of the first and second string portions 42 and 44 on opposed sides of barrel 19 to opposed sides of claw member 46, provides three points of contact or attachment between the claw member 46 and the crossbow 10, which greatly facilitates maintaining claw member 46 in a centered position and provides balanced retraction of the bowstring. It is also contemplated in the invention that centering mechanism 61, such as a roller or boss, may be provided in association with legs of claw member 46 to further facilitate movement of the claw member 46 in a centered position with respect to the barrel 19. Such a centering mechanism may include a centering member 97 attached to each leg that is used to engage the sides of barrel 19 to positively center the claw 46 with respect thereto. Additionally, the hub members 38 and 40 engaging string portions 42 and 44 are rotated upon rotation of the driveshaft 24 at substantially the same rate also providing balanced application of force to claw member 46. Upon operation of the drawing mechanism 22 to cock the crossbow 10, the claw member 46 will move the bowstring into engagement with trigger mechanism 15. To avoid over cranking of the mechanism 22 once the bowstring is in engagement with the trigger mechanism 15, the mechanism 22 may include a clutching device which will prevent further rotation of the shaft and associated hubs 38 and 40 upon application of a predetermined excessive force. Alternatively, when the bowstring is engaged with trigger mechanism 15, a signal or alarm 43 may be activated to indicate to the user that cocking is completed and no further rotation of the drive shaft 24 is needed. The signal or alarm 43 can be audible, visible or otherwise, and may be activated by engagement with the bowstring or claw or otherwise as desired.

The claw member 46 as seen in FIGS. 1 and 7 is selectively coupled to bowstring 16 to draw bowstring 16 to a cocked position. The preferred claw member 46 includes a main body 47 having a central portion which spans the width of the barrel 19, and preferably has a downwardly extending claw guide member 49 disposed at a central portion of the main body 47. The body 47 may further include extending leg members 51 provided on opposed sides of the claw member 46 adjacent the sides of barrel 19, with each of the extending leg portions 51 having a downwardly projecting portion 53 including an aperture 55 or other arrangement to which one of the cable portions 42 or 44 is engaged or coupled. The downwardly projecting portions 53 of legs 51 preferably provide the point of engagement to cables 42 or 44 at a position below the top surface of the barrel 19 and also may optionally include centering members 61 which engage sides of barrel 19. Constructing claw member 46 in this manner allows the forces applied through cable portions 42 and 44 on claw member 46 to be directed downwardly against the top surface of barrel 19 to ensure that claw member 46 slides along the top surface and maintains engagement therewith. The claw guide 49 may be adapted to be positioned within and engage a channel or arrow guide 21 (shown in FIG. 1) to also ensure that claw member 46 is precisely centered with respect to the barrel 19. Again, centering of the claw 46 is generally accomplished by the engagement of legs 51 to cable portions 42 and 44 but the guide 49 further facilitates this. As previously mentioned, engagement of the claw member 46 by means of the cable portions 42 and 44 may be preformed in a variety of ways, including providing separate cable portions extending from the hubs 38 and 40, each of which are separately secured to the downwardly projecting portions 53 of legs 51. An end portion of the separate cable members 42 and 44 may be inserted into aperture 55 and selectively secured in position by means of a set screw 63 or in some other fashion. In this way, the length of each cable member 42 and 44 may be adjusted for balanced retraction of claw member 46. Alternatively, a single cable may be used to form cable portions 42 and 44, with the unitary cable positioned through aperture 55 associated with each of the legs 53 and extending around the main body 47 of claw member 46 at a front portion thereof in a channel 65. In this manner, a single cable forms cable portions 42 and 44, with the unitary cable being slidable with respect to claw member 46 within aperture 55 and channel 65 while maintaining engagement therewith. In this manner, as the drive shaft 24 is rotated by a user, and string portions 42 and 44 are wound upon hubs 38 and 40, the claw member 46 is automatically self-centered for balanced retraction of the bowstring. Upon application of force, via the hubs 38 and 40, the lengths of cable portions 42 and 44 will automatically adjust relative to the claw member 46 so that portions 42 and 44 are of equal length. This self-centering action will continue to take place even as retraction of the bowstring continues, should any differences in the lengths of portions 42 and 44 occur during cocking of the bowstring.

Claw member 46 further preferably includes bowstring engaging portions 57 which may include engaging slots 59 facing rearwardly. The engaging slots 59 positively engage the bowstring 16 to allow claw member 46 to be retracted by means of cable portions 42 and 44 while retaining bowstring 16 under tension. As shown in FIG. 2, to cock the crossbow 10 from an uncocked portion, claw member 46 is initially selectively engaged with bowstring 16 at the position 60. Upon retraction of the cable portions 42 and 44 by operation of the drawing mechanism 22, the claw member 46 is moved to the position as shown at 65, wherein the bowstring 16 is engaged with the trigger mechanism 15 in a firing position. Once in this position, the claw member 46 may be moved forwardly away from trigger 15 and subsequently stored at position 67, being a resting or sleeping position when not in use. To facilitate placement at position 67, the claw guide 49 may be inserted into a small hole or aperture formed in stock 18. The automatic retraction of cable portions 42 and 44 by means of spring 50 also greatly facilitates use, as when the claw member 46 is disengaged from the bowstring 16, cable portions 42 and 44 automatically rewind onto hubs 38 and 40, allowing claw member 46 to be positioned at the sleeping position 67 very easily. The configuration of the claw member 46 and its operation in conjunction with barrel 19 allow engagement to the bowstring 16 at two positions adjacent the edges of barrel 19 when bowstring 16 is in a relaxed position. Upon retraction of claw member 46, the bowstring 16 is retracted in a balanced fashion, resulting in a balanced cocking and a true or straight trajectory for the projectile or arrow being fired from crossbow 10. This balanced retraction of the bowstring 16 is accomplished in a repeatable and simple fashion, and provides significant advantages which are not obtained with other cocking mechanisms or in manually cocking the crossbow. It should be recognized that the general attributes of claw member 46 are obtainable with a wide variety of different particular configurations. In general, the horseshoe or U-shaped configuration where sides of the claw adjacent the sides of barrel 18 provide attachment points which yield a balanced retraction of the bowstring are possible with a variety of designs. The claw member 46 may also be configured to operate with any particular barrel configuration of crossbow 10 as original equipment or retrofitted.

When a crossbow is to be retrofitted, the operator may obtain a retrofit kit. The kit may include the drawing mechanism 22, mounting plates 54, and fasteners 27 disclosed above. Where a claw member 46 is also required, it may also be made a part of the retrofit kit. In cases where the drawing mechanism 22 is not desired, a manually operable claw member 80, described below, may be obtained separately. If the tailstock of the crossbow does not have the required aperture, it may be formed within the tailstock. The tools required to form the aperature, a drill and/or drill bit for example, may also be made part of the retrofit kit. The mounting plates 54 and drawing mechanism 22 are fastened to the tailstock as described above. Then, where used, the claw member 46 is engaged to the first and second string portions of the drawing mechanism 22. The claw member (46 or 80) may have the centering mechanism 61 (which may include later to be described cams 90) adjusted to center the claw member with respect to the crossbow barrel. The claw member 80 or drawing mechanism 22 with claw member 46 is then used as described elsewhere in this application.

Figure 8:
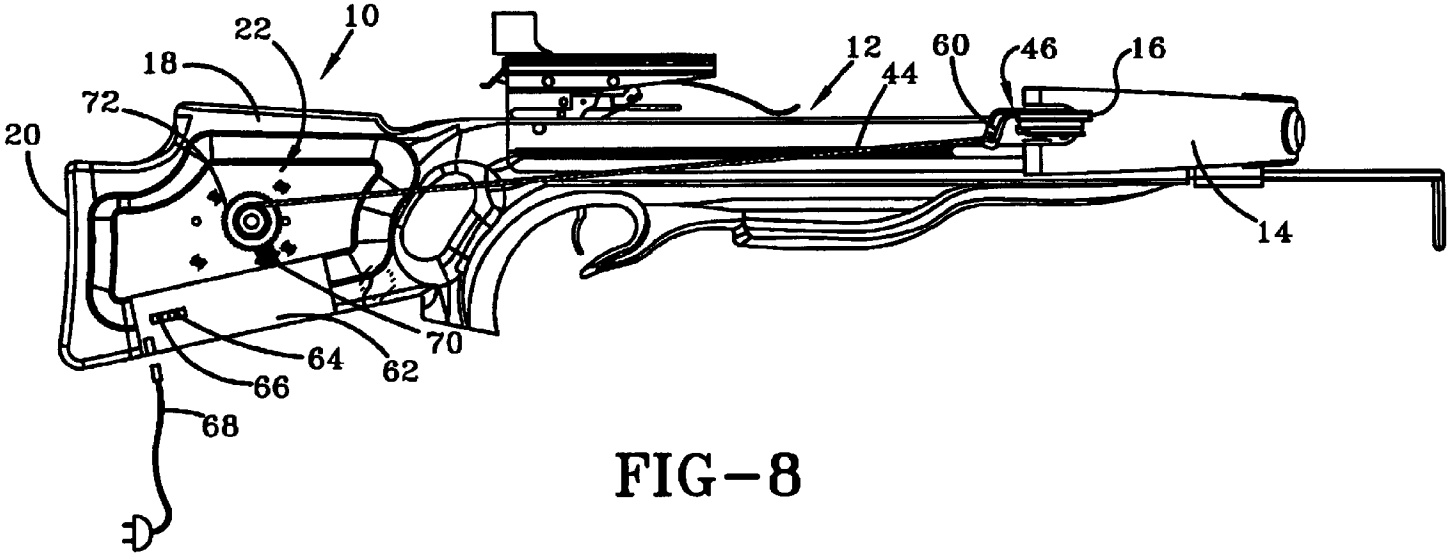
FIG. 8 illustrates an overall side view of a crossbow having a crossbow bowstring drawing mechanism in accordance with a second preferred embodiment of the present invention.

Referring now to FIG. 8, which illustrates an overall side view of a crossbow having a crossbow bowstring drawing mechanism in accordance with a further embodiment of the present invention. In this embodiment, an integral rotational power source 62 is provided in association with crossbow 10. The integrated power source 62 is coupled to selectively permit driving of the hubs 38 and 40 upon which cable portions 42 and 44 are wound for operation of the mechanism 22. Although the integrated rotational power source 62 can be provided in a variety of manners to accomplish this function as contemplated in the invention, a particular embodiment as shown in FIG. 8 may include an intermediate gear 70 which is driven by the power source 62 and in turn causes rotation of drive gear 72 and the corresponding hubs 38 and 40 as described in the prior embodiment. In the preferred embodiment, the operation of the integrated rotational power source 62 is controlled by a forward switch 64 and reverse switch 66 mounted on stock 18 to permit control of the rotational direction of rotation for cocking or uncocking of the crossbow 10. It is also seen that integral rotational power source 62 can receive electrical energy from extension cord 68 plugged into a household electrical current source, to recharge the power source 62 or to provide power thereto. Thus, an internal or external electrical battery could be used as the source of electrical power and such electrical batteries could be disposed when depleted, or more preferably, rechargeable to allow repeated use.

Figure 9:
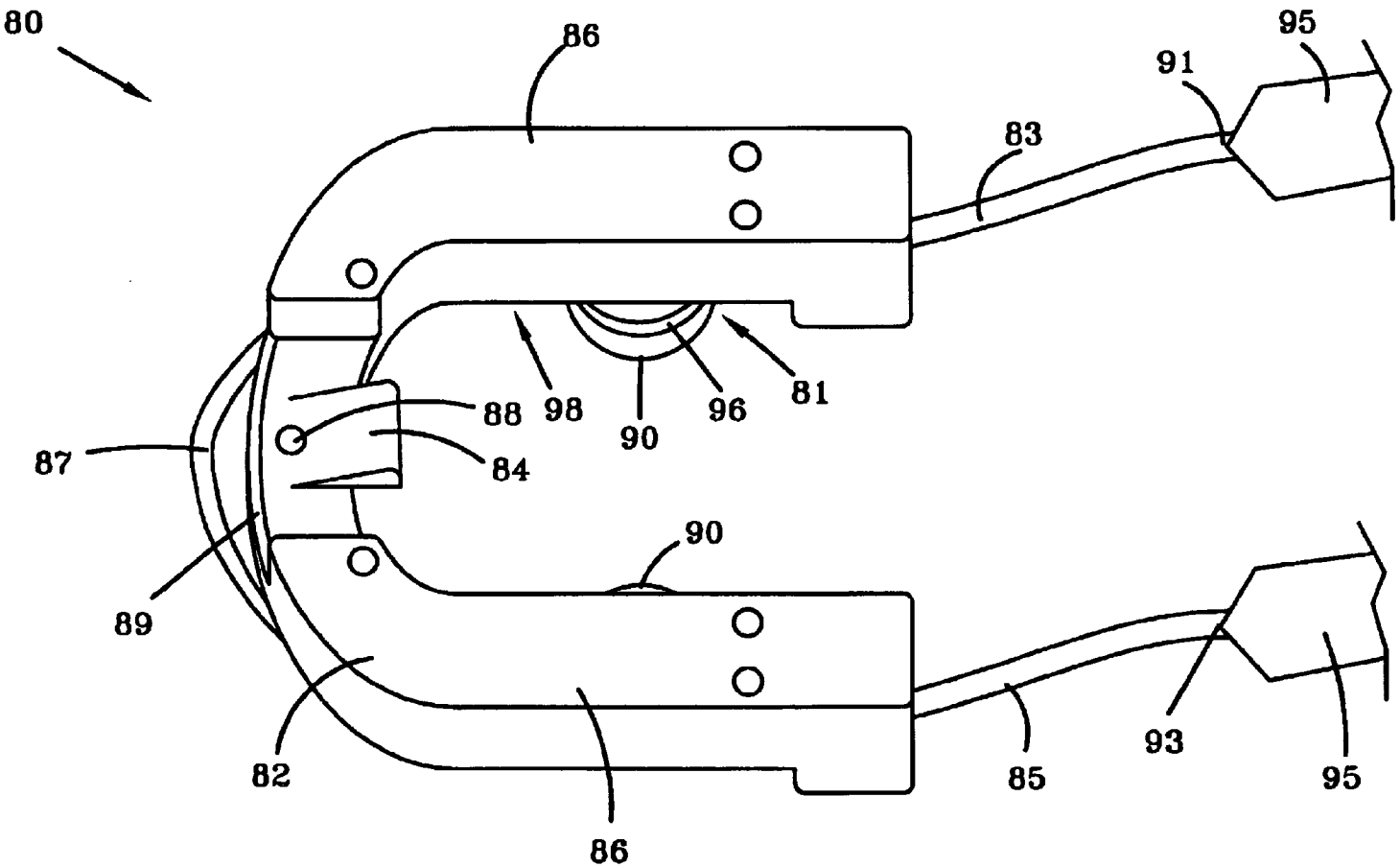
FIG. 9 is a top view of another claw member embodiment intended for the manual cocking of a crossbow.
Figure 10:
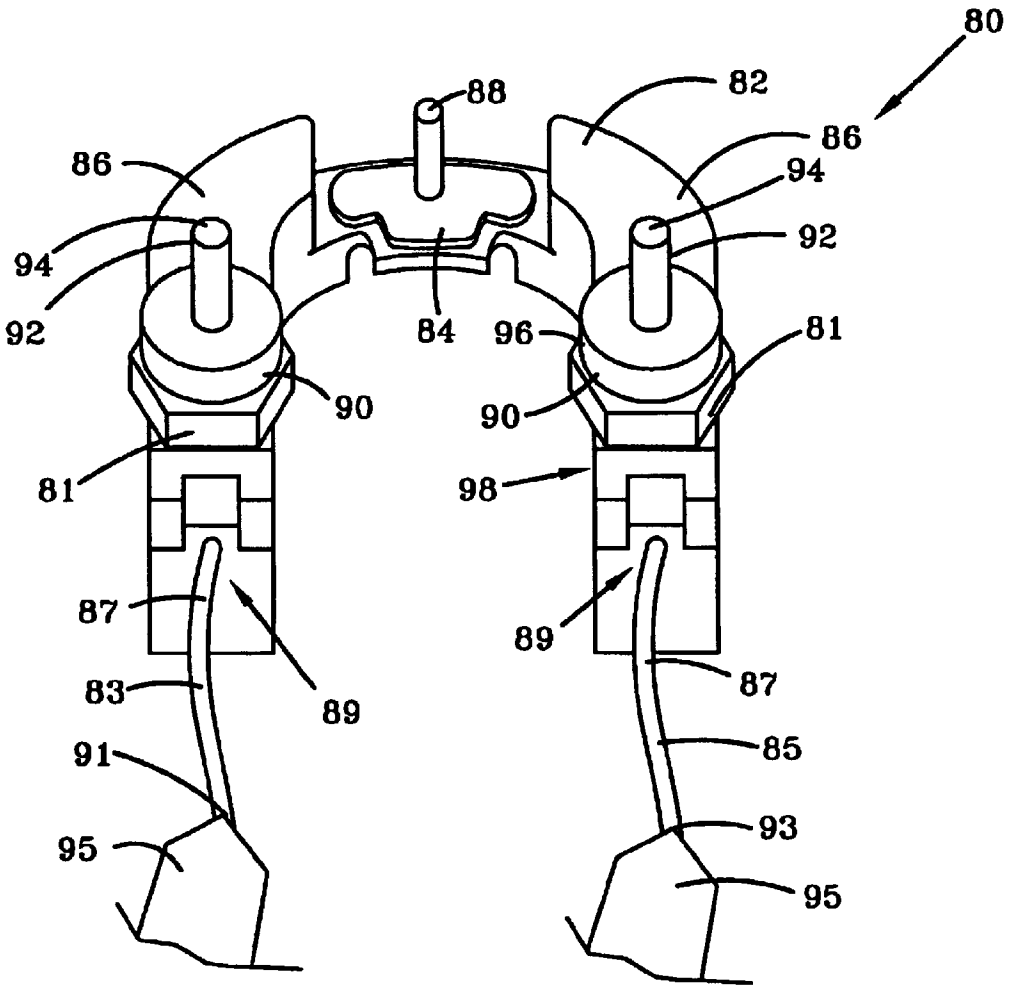
FIG. 10 is a perspective bottom view of the claw member of FIG. 9 showing the cams used to center the claw member with respect to the crossbow barrel.

Referring now to FIGS. 9–10, another embodiment claw member 80 is shown. The claw member 80 is intended for manual cocking of a crossbow so that a drawing mechanism as discussed above is not required. The claw member 80 includes a body 82 having a center portion 84 and a pair of side portions 86 extending from the center portion 84. A guide member 88 preferably extends downwardly from the center portion 84 as shown and is intended to be received within the channel in the crossbow barrel as the guide member 49 discussed above. A bowstring engaging portion 81 receives the bowstring that is to be placed into the cocked position. In the preferred embodiment, each side portion 86 has a bowstring engaging portion 81. First and second string portions 83, 85 have distal ends 91, 93 that extend from the side portions 86. Each string portion 83, 85 may be individually connected to the respective side portion 86 but in the preferred embodiment a single string 87 provides both string portions 83, 85. The use of the single string 87 balances the force exerted on the claw member 80 and thus on the bowstring because if a greater force is exerted on one string portion the string 87 simply slides within a string reception groove 89 on the claw member 80 thereby balancing the force applied. As shown, the distal ends 91, 93 may include handles 95 to assist the operator in applying a force to the string portions 83, 85 and thus to the bowstring to place the bowstring in the cocked position. In operation, to cock the crossbow the operator engages the bowstring engaging portion 81 of with the bowstring at the uncocked position and places the guide member 88 within the barrel channel. A force is then applied to the first and second string portions 83, 85 such as by pulling on the handles 95 generally along the longitudinal length of the crossbow main beam. The bowstring in thus placed into a cocked position and is engaged with the trigger mechanism.

With continuing reference to FIGS. 9–10, the claw member 80 may also include a pair of cams 90 that are operatively connected to the side portions 86 as shown. The cams 90 are used to contact the opposing outer sides of the crossbow barrel to thereby center the claw member 80 with respect to the barrel as the claw member 80 is drawn and the crossbow is cocked. It should be understood then that the cams 90 serve a similar function to the previously described centering mechanism 61 and that the cams 90 could be used in place of the centering mechanism 61 on the previously described claw member 46. Preferably the cams 90 are adjustably connected to a bottom surface of the side portions 86. The cams 90 could also be otherwise attached to the side portions 86 such as to a top surface of the side portions 86. By adjustably connected it is meant that the cams can be adjusted by the operator to engage differing sizes (widths) of crossbow barrels. Preferably the cams 90 are held to the side portions 86 with adjustment screws 92. The adjustment screws 92 have tool reception areas 94 and thus may be loosened to permit the cams 90 to be adjusted and then tightened to hold the cams 90 in place for use with a particular barrel. The cams 90 shown are disc shaped and the adjustment screws 92 are offset with respect to the center of the cams 90 to provide the required cam action. In other words, as the cam 90 is pivoted about the adjustment screw 92, the distance between the outer edge 96 of the cam 90 and the inner edge 98 of the side portion 86 can be adjusted (changed). This enables the cams 90 to be adjusted such that the outer edges 96 contact the outer sides of the crossbow barrel. The cams 90 and guide member 88 provide three points of contact between the claw member 80 and the crossbow barrel. It should be understood that other methods and apparatuses of providing the cam action is here contemplated. The cams may, for example, be non-symmetrically shaped permitting the adjustment screws to be attached at the center of the cams. Other means of holding the cams to the claw member may also be used to replace the adjustment screws and are here contemplated.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A method of cocking a crossbow, comprising the steps of:

providing a crossbow having a main beam, a bowstring and a trigger mechanism, said bowstring being selectively positionable into cocked and uncocked positions;

providing a drawing mechanism operatively connected to said beam, said drawing mechanism including first and second string portions, said drawing mechanism operatively connected to a pawl biased in a first position;

providing a claw member that is operatively connected to said first and second string portions;

engaging said claw member with said bowstring at said uncocked position;

operating said drawing mechanism;

placing said bowstring into said cocked position; and, engaging said bowstring with said trigger mechanism.

2. The method of claim 1 wherein the step of providing a claw mechanism includes:

providing a claw member that is operatively connected to said first and second string portions, the claw member having at least a first roller;

wherein the step of operating said drawing mechanism, comprises the step of:

retracting said first and section string portions within said drawing mechanism thereby retracting said claw member toward said drawing mechanism; and, further comprising the step of:

automatically centering the claw member.

3. The method of claim 2 further comprising the steps of:

providing said drawing mechanism with first and second hubs that operatively receive said first and second string portions respectively, wherein the pawl is operatively communicated to limit motion of the first and second hubs in one direction; and, wherein the step of retracting said first and section string portions within said drawing mechanism comprises the steps of, A) rotating said first and second hubs in a first direction; and, B) winding said first and second strings portions around said first and second hubs respectively C) preventing said first and second hubs from rotating in a second direction.

4. The method of claim 3 further comprising the steps of:

providing said drawing mechanism with a pinion shaft operatively connected to said first and second hubs, a drive shaft, and a gear mechanism that operatively connects said drive shaft to said pinion shaft; and, wherein the step of rotating said first and second hubs in a first direction, comprises the step of rotating said drive shaft in a second direction.

5. The method of claim 4 further comprising the steps of:

providing said drawing mechanism with a housing that holds said first and second hubs, said drive shaft, and said gear mechanism within;

providing said drive shaft with a driving head that is accessible through an opening in said housing; and, magnetizing said driving head for use in holding an external source into operative engagement with said driving head.

6. The method of claim 1 further comprising the steps of:

providing the main beam with a barrel having a longitudinally extending channel;

providing the claw member with a claw guide member and a centering mechanism; and, wherein the step of engaging said claw member with said bowstring at said uncocked position comprises the step of positioning said claw guide member within said channel thereby centering said claw member with respect to said barrel.

7. The method of claim 6 further comprising the steps of:

providing the claw member with first and second leg members that extend down opposite sides of said barrel and with first and second centering members operatively connected to said first and second leg members respectively; and, wherein the step of engaging said claw member with said bowstring at said uncocked position, further comprises the step of adjusting said first and second centering members to engage said opposite sides of said barrel thereby centering said claw member with respect to said barrel.

8. The method of claim 1 wherein the step of engaging said bowstring with said trigger mechanism, comprises the step of:

activating a signal to indicate that cocking is completed.

9. The method of claim 1 wherein after the step of engaging said bowstring with said trigger mechanism, the method further comprises the step of:

placing said claw member into a rest position on said main beam.

10. The method of claim 9 wherein after the step of placing said claw member into a rest position on said main beam, the method further comprises the step of:

retracting the first and second string portions.

11. The method of claim 1, wherein said drawing mechanism is contained within a housing.

12. The method of claim 1, wherein said pawl is operatively connected to a reduction gear arrangement.

13. A method of cocking a crossbow, comprising the steps of:

providing a crossbow having a main beam, a bowstring and a trigger mechanism, said bowstring being selectively positionable into cocked and uncocked positions;

providing a drawing mechanism operatively connected to said beam, said drawing mechanism including first and second string portions;

providing a housing that is selectively fixedly attached to the crossbow, wherein the housing substantially encloses the drawing mechanism;

providing a claw member that is operatively connected to said first and second string portions;

moving the claw member wherein the first and second string portions are extended out from the housing;

engaging said claw member with said bowstring at said uncocked position;

operating said drawing mechanism;

placing said bowstring into said cocked position; and, engaging said bowstring with said trigger mechanism.

14. A crossbow, comprising:

a longitudinally extending main beam having a longitudinally extending track thereon; a pair of outwardly extending arms having distal ends, said pair of outwardly extending arms extending transversely from opposite sides of maid longitudinally extending main beam;

a crossbow bowstring attached to said distal ends of said pair of outwardly extending arms;

a crossbow trigger mechanism mounted on said longitudinally extending main beam;

a claw member mounted to move along said longitudinally extending track of said longitudinally extending main beam, said claw member having a first attachment point on a first side of said longitudinally extending track and a second attachment point on a second side of said longitudinally extending track, said claw member being capable of moving said crossbow bowstring from a first uncocked position to a second cocked position in said crossbow trigger mechanism; and a crossbow bowstring drawing mechanism including a first string member along said first side of said longitudinally extending track, said first string member having a distal end attached to said first attachment point of said claw member, and a second string member along said second side of said longitudinally extending track, said second string member having a distal end attached to said second attachment point of said claw member, said crossbow drawing mechanism being capable of retracting said first string member and said second string member along said longitudinally extending track at substantially the same rate, said crossbow drawing mechanism further comprising a pawl biased in a first position.

15. The crossbow of claim 14, wherein said drawing mechanism further comprises a gear mechanism having a drive shaft operatively connected to a rachet gear, wherein said rachet gear is adapted to permit rotation of said drive shaft in one rotational direction, said rachet gear adapted to prohibit rotation of said drive shaft in a second rotational direction via said pawl.

16. The crossbow of claim 15, wherein said pawl is resiliently biased by a pawl spring to a position between adjacent teeth of said rachet gear.

17. The crossbow of claim 15, wherein said drawing mechanism is contained within a housing.

* * * * *